United States Patent [19]

Anderson

[11] Patent Number: 4,906,049

[45] Date of Patent: Mar. 6, 1990

[54] RIPPER USING A HYDRAULIC HAMMER AND A METHOD FOR MAKING THE IMPROVEMENT

[75] Inventor: Jack T. Anderson, Independence, Ohio

[73] Assignee: N. P. K. Construction Equipment, Inc., Walton Hills, Ohio

[21] Appl. No.: 276,631

[22] Filed: Nov. 28, 1988

[51] Int. Cl.[4] ..... E21C 3/04

[52] U.S. Cl. ..... 299/37; 299/69; 299/94; 173/133

[58] Field of Search ..... 299/37, 38, 69, 85, 299/86, 91, 94; 173/128, 133

[56] References Cited

U.S. PATENT DOCUMENTS

| | | | |
|---|---|---|---|
| 1,880,337 | 10/1932 | App | 173/133 |
| 3,519,309 | 7/1970 | Engle et al. | 299/91 |
| 3,770,322 | 11/1973 | Cobb et al. | 299/37 |
| 4,034,817 | 7/1977 | Okada | 173/134 |
| 4,131,165 | 12/1978 | Wanner et al. | 173/133 |
| 4,679,857 | 7/1987 | Roussin et al. | 299/37 |
| 4,724,912 | 2/1988 | Miyazaki et al. | 173/162 R |

FOREIGN PATENT DOCUMENTS

| | | | |
|---|---|---|---|
| 3039617 | 5/1982 | Fed. Rep. of Germany | 173/133 |

*Primary Examiner*—Jerome W. Massie
*Assistant Examiner*—Terry Lee Melius
*Attorney, Agent, or Firm*—Body, Vickers & Daniels

[57] ABSTRACT

An improved ripper using a hydraulic hammer with a rotating long service life hammer tool is provided. The tool is cylindrical with a large cylindrical upper portion and a central portion of reduced diameter. The tool is retained in the hammer by means of a pin passing through the tool cavity of the hammer housing which prevents passage of the large upper portion.

12 Claims, 3 Drawing Sheets

FIG. 1
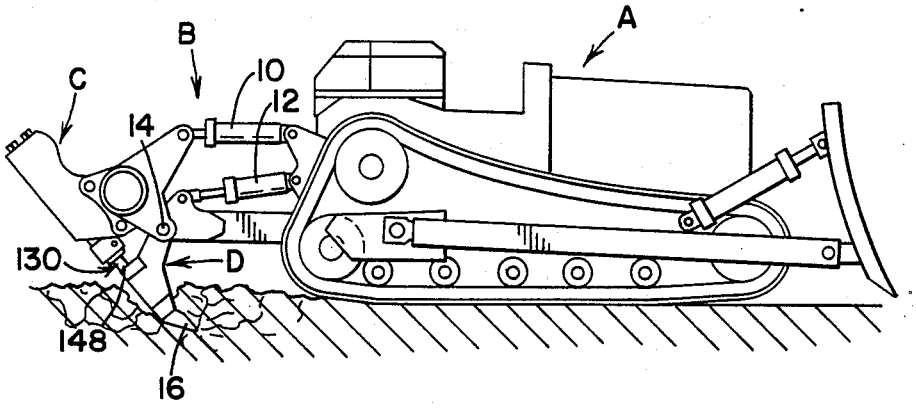
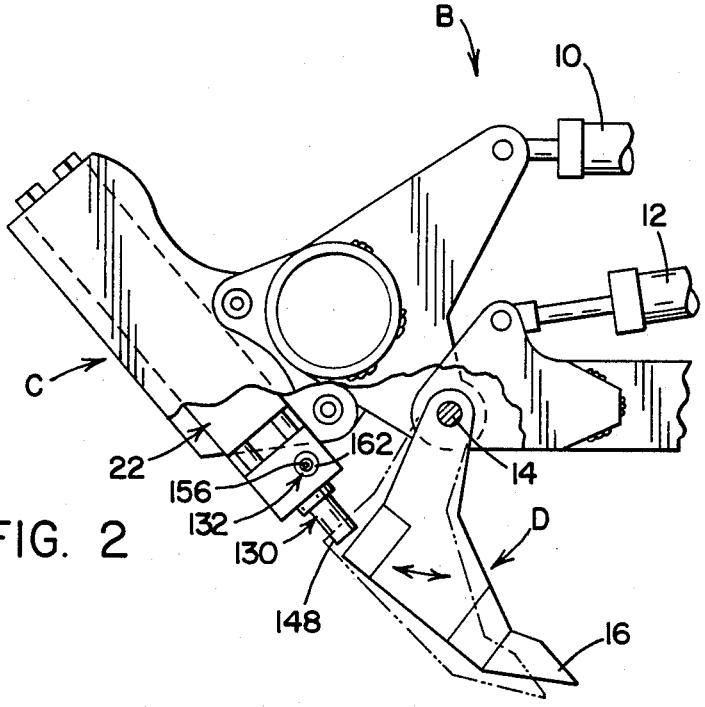
FIG. 2

RIPPER USING A HYDRAULIC HAMMER AND A METHOD FOR MAKING THE IMPROVEMENT

FIELD OF THE INVENTION

The present invention pertains to rippers of the type carried on the rearward end of a tractor and more particularly to an improvement in a hydraulic hammer allowing the economical use of such hammers in rock ripping operations at mines, quarries and the like.

INCORPORATION BY REFERENCE

U.S. Pat. No. 4,679,857 issued July 14, 1987 entitled "Mounting Frame for Linear Impact Ripping Assembly" is incorporated herein by reference.

BACKGROUND OF THE INVENTION

Ripping is used in mines, quarries and similar industrial establishments to break up bodies of rock and ore. In the past, ripping has been accomplished by use of a tractor or bulldozer pulling a ripping tool behind it. Heavy, powerful tractors, commonly called bulldozers, are provided with hydraulically controlled mounting means on the rear end. A plow or ripping shank is movably mounted upon this mounting means and can be raised and lowered hydraulically by the operator of the bulldozer. Ripping is accomplished by lowering the ripping shank into the ground behind the bulldozer and moving the bulldozer in a forward direction. The ripping shank or plow is drawn through the ground fracturing the rock before it so that it may be removed and further processed.

In the past, rippers have consisted of a fixed shank extending downwardly from the rear of the bulldozer and a replaceable tip on the shank. The ripping action was achieved entirely by the force generated by the forward movement of the bulldozer transmitted through the ripping shank to the ripping tip.

While ripping was useful in many applications, it had its problems. The only force acting on the ripper was the force of forward motion of the tractor. Hard or tightly laminated rock was very difficult to rip or could not be ripped at all. Ripping of some rocks was uneconomical. Ripping of some rocks required close operator attention and high levels of operator skill as the operator had to match control of the tractor and ripper to variations in rock strength and lamination thickness. Ripping operations were also hard on the tractor and ripper. As all the force used in ripping was generated by the tractor moving forward, wear on the entire tractor has accelerated.

In addition to the above described problems, ripping of many types of rock were simply too difficult and expensive to be economically feasible.

Attempts have been made to overcome these problems by use of impact hammers acting on the ripping shank. U.S. Pat. No. 4,679,857 describes a mounting frame for bringing an impact hammer on a heavy tractor. However, problems prevented the economical use of such arrangements. One major problem was impact hammer tool life. The portion of the impact hammer which strikes the ripping shank is a heavy steel cylinder which is often hardened called the tool. The tool must be easily replaceable as it is short lived compared to other elements of the system. However, the tool must have a reasonable service life or ripping cannot be economically achieved. In prior art impact hammers used in ripping the tool failed too often. The tool would fail by spalling, cracking, or otherwise. Ripping tractor down time for tool replacement and the like and the cost of tool replacement and the like prevented widespread use of impact hammer ripping.

These and other problems are overcome by the present invention wherein an hydraulic impact hammer is successfully mated to a ripping shank drawn by a heavy tractor.

SUMMARY OF THE INVENTION

In accordance with the present invention there is provided a tractor having a ripping shank and tip mounted at its rear end and a hydraulic hammer mounted above the ripping shank delivering heavy impacts to the shank through a tool which is rotatable about its axis.

Further in accordance with the invention the hydraulic hammer is located above a ripping shank which is held in place below the rotatable tool of the hammer whereby the tool is restrained from excessive downward movement.

Still further in accordance with the invention, the hydraulic hammer tool is retained in a generally cylindrical central cavity in the hammer and is generally cylindrical in shape having an upper cylindrical portion with a first diameter, a central cylindrical portion with a second diameter smaller than the first diameter and the tool is retained in the central cavity by means of a pin passing through the central cavity near its periphery.

Yet further in accordance with the invention the retaining pin is surrounded by bushings on either end fully occupying large, conventional, holes through the housing of the hydraulic hammer while being small enough to allow rotation of the hammer tool within the cavity.

Yet further in accordance with the invention a rotatable hammer tool is provided sized to fit already existing hydraulic hammers and a pin and bushing set is also provided which will fit conventional retaining pin holes and allow the new rotating tool to freely rotate in conventional quick change hydraulic hammers.

The primary object of the present invention is to provide a ripping tractor with an impact hammer having a quick change rotatable tool.

Another object of the present invention is to provide a ripping tractor with a hydraulic hammer having a tool which will survive repeated impacts against a ripping shank.

A still further object of the present invention is to provide an impact hammer having a light retaining pin sufficiently spaced from the center axis of the hammer tool to allow the free rotation of the hammer tool within the central cavity of the hammer.

Yet another object of the present invention is the provision of an impact hammer having a tool which is both rotatable and quickly changeable.

It is another object of the invention to provide an impact hammer which will have a long tool life in the event that the face of the hammer tool is not perfectly aligned with the striking surface of the ripping shank.

It is still another object of the present invention to provide an impact hammer which will have a long tool life in the event that a persistent misalignment between the hammer tool and the ripping shank causes stress concentrations at one point of impact upon the ripping shank.

Still another object of the present invention is the provision of the hydraulic hammer tool and retaining means which can be retrofitted to existing non-rotatable quick tool change hydraulic hammers in the field.

It is still another object of the present invention to provide an improved hydraulic hammer allowing for the economical hammer ripping of rocks which have heretofore been uneconomical to rip.

These and other objects and advantages of the invention will become apparent from the following description of a species thereof taken together with the accompanying drawings.

BRIEF DESCRIPTION OF THE DRAWINGS

The invention may take physical forms certain parts and arrangements of parts, a preferred embodiment of which will be described in detail in the specification and illustrated in the accompanying drawings which form a part hereof and wherein:

FIG. 1 is a schematic side view of a tractor carrying an impact hammer in accordance with the present invention;

FIG. 2 is an enlarged view of the hydraulic hammer and ripping shank of FIG. 1;

DETAILED DESCRIPTION OF A PREFERRED EMBODIMENT

Figure 3:
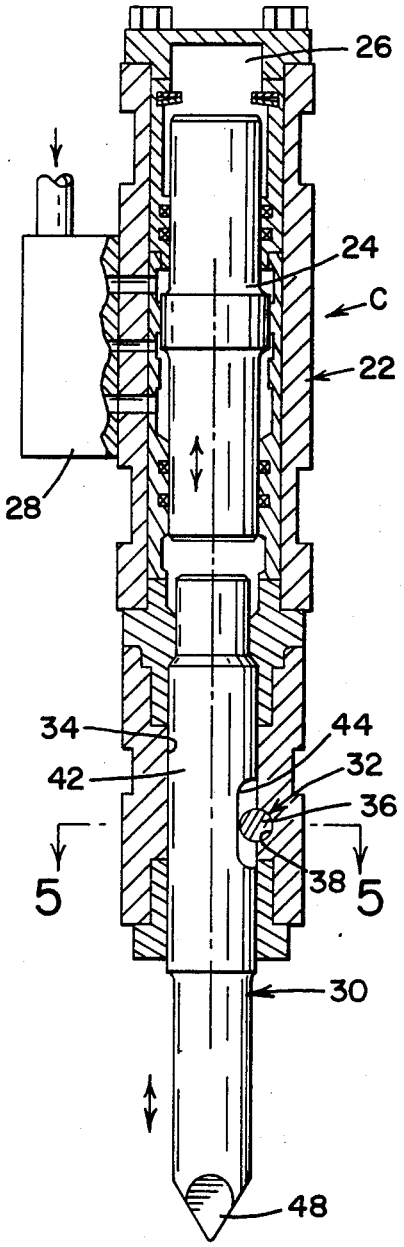
FIG. 3 (PRIOR ART)
FIG. 3 is a view of a conventional hydraulic hammer partially cut away.

Referring now to the drawings wherein the showings are for the purposes of illustrating a preferred embodiment of the invention only and not for the purpose of limiting the same, FIG. 1 shows a heavy duty tractor A such as is available from Caterpillar, Inc., Peoria, Illinois U.S.A. Such tractors are widely used in mining and quarrying operations and have been used in ripping operations in the past. In the past, however, ripping operations have normally been performed by use of a fixed ripping device supported behind the tractor A without the use of a hydraulic hammer.

A mounting B is provided at the rear of the tractor A. The mounting provides a point of attachment for a hydraulic hammer C and ripping shank D. The mounting B is provided with hydraulic cylinders 10, 12 which allow the operator to raise the hydraulic hammer C and ripping shank D into traveling position, lower the hydraulic hammer C and ripping shank D into operating position, and rotate the hydraulic hammer C and ripping shank D into a preferred operating orientation. The hydraulic hammer C and ripping shank D are mounted together so that their relative orientation remains roughly constant in both the traveling and working elevation and in various rotational positions. The mounting B is described in detail in U.S. Pat. No. 4,679,857 assigned to Caterpillar, Inc. which is incorporated herein by reference.

The weight of a tractor equiped with a hydraulic hammer ripping arrangement can exceed 250,000 pounds. The weight of the hydraulic hammer itself can exceed 10,000 pounds. The impact force exerted upon the shank D can exceed 400,000 pounds. Substantial forces are involved and significant investments are required for even one piece of equipment. Reliable operation without excessive need for maintenance down time is required.

As can be seen in FIG. 2, the hydraulic hammer C is disposed above the ripping shank D. While mounted to be generally in line, the two elements are mounted separately. A slight rotation of the shank about its mounting pin 14 occurs when a hammer blow is delivered by the hydraulic hammer C. This drives the ripping tip 16 into the body of rock to be ripped. As is conventional, the ripping tip 16 is replaceable as it is a high wear item.

Figure 4:
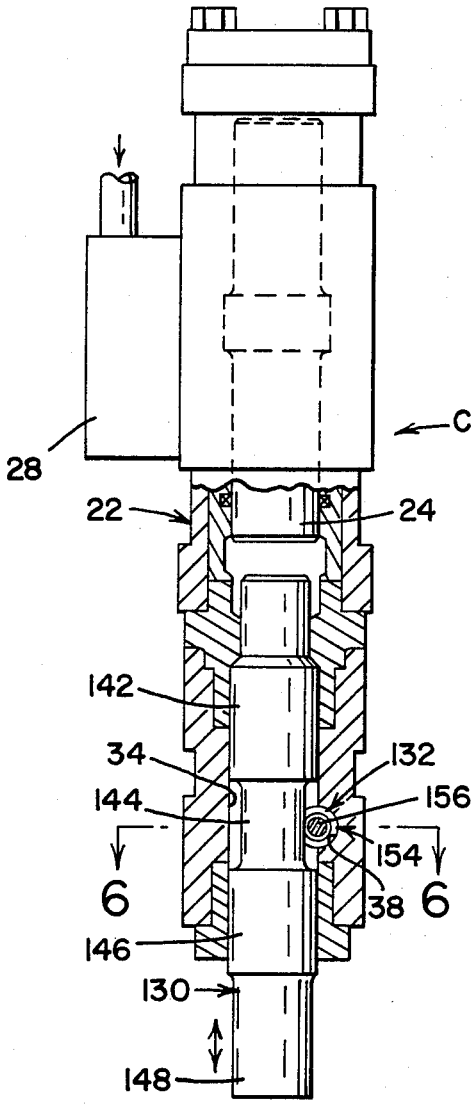
FIG. 4 is a view, partially in section, similar to FIG. 3 but showing the rotatable tool and rotatable tool retaining means of the present invention.
Figure 5:
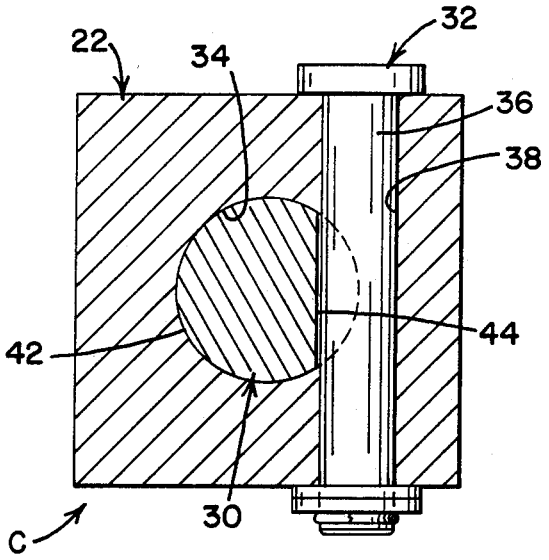
FIG. 5 (PRIOR ART)
FIG. 5 is a cross section of the hydraulic hammer seen in FIG. 3 showing the hammer tool and tool retaining means of a conventional hydraulic hammer; and, FIG. 6 is a cross section of FIG. 4 showing the tool and tool retaining means of the present invention.
Figure 6:
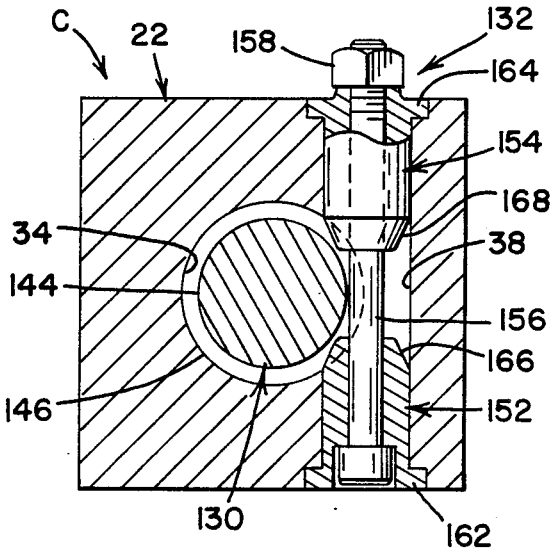

The hydraulic hammer C is shown in more detail in FIGS. 4 and 6. FIGS. 4 and 6 are shown next to FIGS. 3 and 5 which show a prior art hydraulic hammer for purposes of comparison.

A hydraulic hammer is comprised of a housing 22, a piston 24, a gas chamber 26, a hydraulic fluid control means 28, a tool 30, and a tool retaining means 32. In operation, the hydraulic fluid control means 32 directs hydraulic fluid into the housing in a manner which forces the piston 24 upwardly into the gas chamber 26 compressing the gas contained therein. Once the piston 24 reaches a predetermined height in the housing 22, the driving pressure of the hydraulic fluid is released by the hydraulic fluid control means 28 and the pressure of the gas in gas chamber 26 drives the piston downwardly into contact with the tool 30. The tool 30 is guided within a central cavity 34 of the housing 22. The piston imparts great force to the tool 30 at the bottom of its downward stroke and forces the tool downwardly into impact with the rock or other substrate to be broken. As can be seen in FIGS. 3 and 5, the tool retaining means 32 is comprised of a robust pin 36 contained in a cylindrical hole 38. The hole 38 passes through the entire thickness of the housing 22 and has an axis which is perpendicular to the axis of the central cavity 34. The hole 38 intersects the central cavity 34 near its periphery. The robust pin 36 is sufficiently large in diameter to completely fill the cylindrical hole 38 and is sufficiently long to extend outwardly on both ends of the hole 38 where it is fixed in place by cotter pins or the like.

The conventional tool 30 is shown retained in the central cavity 34. The tool is comprised of a cylindrical portion 42 which is slightly smaller in diameter than the interior diameter of the central cavity 34. A slot 44 is provided in the cylindrical portion 42. The slot 44 is sufficiently deep and long to allow the tool 30 to move through its entire range of vertical travel without interference from the robust pin 36. The slot 44 and the robust pin 36 thus provides a retaining means 32 for the tool 30. The tool 30 may move downwardly so long as the robust pin is accommodated by the slot 44. At the end of the range of travel of the tool 30, the upper cylindrical portion 42 encounters the pin 36 and further downward movement is restrained.

The pin 36 must be robust to absorb the full force of downward movement of the tool 30. While in normal operation, the major portion of the hammer force will be absorbed by the rock being broken. However, when rock is freshly broken or when the hydraulic hammer C is being removed from the work, hammer blows may be delivered to the tool while the tool is not resting upon a substantial surface. Only the robust pin 36 is available to absorb the shock and prevent the tool from being forcefully ejected from the hydraulic hammer C.

The slot 44, of necessity, cuts deeply into one side of the tool 30. The tool 30 is thereby prevented from rotating about its axis by the positioning of the robust pin 36 in the slot 34. However, the pin and slot arrangement provides the positive attribute of allowing a quick tool change. When the working end 48 of the tool 30 becomes chipped, dull, or otherwise requires replacement, the tool 30 can be removed by first removing the robust pin 36, allowing the tool 30 to drop from the central cavity 34 and replacing the tool 30 with a new tool which is retained in place by reinserting the robust pin 36. The quick change feature is required as tools are subject to wear and breakage in the field.

FIGS. 4 and 6 show a hydraulic hammer in which the tool and retaining means of the present invention have been installed. The housing 22, the piston 24, the gas chamber 26, the hydraulic fluid control means 28, the central cavity 34 and the cylindrical hole 38 are all identical to the same elements in the prior art hydraulic hammer seen in FIG. 3. The rotatable tool 130 differs from the prior art tool 30 and the tool retaining means 132 differs from the prior art retaining means 32. The rotatable tool 130 has an upper cylindrical portion 142, a central cylindrical portion 144, a lower cylindrical portion 146 and a working end 148. The upper cylindrical portion 142 and the lower cylindrical portion 146 have diameters slightly less than the interior diameter of the central cavity 34. The central cylindrical portion 144 has a diameter less than the diameter of the upper cylindrical portion 142 but still sufficiently large to handle the impact forces imparted upon it by the piston 24. The upper cylindrical portion 142, the central cylindrical portion 144 and the lower cylindrical portion 146 are coaxial. The entire rotatable tool 130 is therefore free to rotate within the cavity 34.

The rotatable tool retaining means 132 is shown in detail in FIG. 6. It comprises a first bushing 152, a second bushing 154, a cap screw 156 and a nut 158. The first bushing 152 is comprised of a cylindrical portion having an outside diameter slightly smaller than the inside diameter of cylindrical hole 38. A flange 162 is provided on the outboard end of the first bushing preventing it from sliding inwardly into the cylindrical hole 38. A similar flange 164 is provided on the outboard end of the second bushing 154 preventing it from sliding into the cylindrical hole 38. The first bushing 152 is provided with a conical inboard end 166. The second bushing 154 is provided with a similar conical inboard end 168. The cap screw 158 passes through the centers of the two bushings 152, 154. The nut 158 is threaded upon the cap screw 156 and a high torque applied fixing the two bushings and the cap screw and nut in place. Alternatively, the internal passage of bushing 164 can be threaded and nut 158 discarded. A slightly shorter capscrew 156 is then used and the retaining means does not project beyond the side of the hammer. As can be best seen in FIG. 6, the shank of the cap screw 156 passes through the central cavity 34 of the housing 22 near the periphery of the central cavity 34. The cap screw 156 is sufficiently spaced from the axis of the central cavity 34 such that the central cylindrical portion 144 of the rotatable tool may move freely upwardly and downwardly and rotate. However, the cap screw 156 is sufficiently close to the axis of the central cavity 34 to prevent passage of the upper cylindrical portion 142 of the tool 130. The rotatable tool 130 is effectively held within the cylindrical cavity 34.

As can be seen in FIG. 6, the conical portion 166, 168 of the first and second bushings 152, 154 also are disposed slightly within the central cavity 34 of the housing 22. These conical portions are sufficiently spaced from the axis of the central cavity 34 to allow movement of the central cylindrical portion 144 of the rotatable tool 130. However, the conical portions of the bushings also will prevent passage of the upper cylindrical portion 142 of the rotatable tool 130.

Referring now to FIGS. 1 and 2, it is seen that the working end 148 of the rotatable tool 130 rests against ripping shank D. The mass of the ripping shank D will absorb the impact force on the tool 130 even if the tip 16 is not in contact with solid rock. The ripping shank is sufficiently close to the hydraulic hammer C such that the tool 130 will not impact upon mere air during normal operations even if the ripping shank and tip are not against rock. The rotatable tool retaining means 132 does not need to absorb the full impact force from the piston 24 acting on the rotatable tool 130.

Importantly, the rotatable tool retaining means 132 allows the rotatable tool 130 to rotate within the central cavity 34. The working end 148 of the tool 130 will impact upon ripping shank D in various conditions of load. Perfect alignment between the working end 148 of the rotatable tool 130 and the ripping shank D is not always achieved. If impact between the working end 148 and ripping tool D occurs consistently with the working end 148 in the same orientation, the working end is likely to wear in one place prematurely, spall or otherwise fail. Rotatable tool 130 is often comprised of hardened steel and is often large in size. The diameter of the tool can be up to 6.9 inches. If the tool fails rapidly and must be replaced often, economical ripping cannot be achieved. Allowing the tool to rotate spreads the cumulative effect impact force throughout the entire tool face and greatly decreases failure due to fatigue, spalling, cracking, and other factors. Economical ripping in very hard materials can now be performed.

An alternate tool retaining means for use in the invention has also been developed. In the alternate retaining means, a pin is fabricated from a single piece of stock having an enlarged head portion with the outside dimensions of the first bushing 152 and a long cylindrical extension occupying the volume occupied by the shank of the cap screw 156 in FIG. 6. A bushing similar to the second bushing 154 surrounds a portion of the cylindrical extension opposite the enlarged head portion. A washer is placed around the cylindrical extension on the outside of the bushing and the entire retaining means is held together in the cylindrical hole 38 by a cotter pin or the like passing through a hole in the cylindrical extension. This and other modifications and alterations will occur to others upon their reading and understanding of this specification. It is intended that all such modifications and alterations be included insofar as they come within the scope of the claims or the equivalents thereof.

Having thus defined the invention, the following is claimed:

1. A ripper comprising:

(a) a tractor having a hydraulic power source;

(b) a shank connected to said tractor supporting a tip adapted to break rock; and, (c) a hydraulic hammer mounted on said tractor comprising a housing having a generally cylindrical central cavity and a hole passing through said housing at a right angle to said central cavity and intersecting said central cavity; a generally cylindrical tool having a longitudinal axis, a generally cylindrical upper portion having a first tool diameter, a generally cylindrical central portion having a second tool diameter, a lower portion and adapted to deliver impact; said housing central cavity having a cavity diameter larger than said first tool diameter, said central cavity surrounding a portion of said tool; and a tool retaining means comprising at least one bushing fitting snugly in said hole and a pin passing through said bushing and fixing said bushing in place, a portion of said tool retaining means extending into said central cavity sufficient to prevent passage of said tool upper portion and not interfering with axial or rotational movement of said tool center portion, said hammer mounted on said tractor such that said tool delivers impact to said shank, said tool being freely rotatable about said longitudinal axis and movable along said longitudinal axis to receive and deliver repeated hammer blows.

2. The ripper of claim 1 wherein said hole contains a first bushing and a second bushing, said first bushing being disposed in said hole on a first side of said central cavity and said second bushing disposed in said hole on a second side of said central cavity, said pin passing through said first bushing and said second bushing.

3. The ripper of claim 2 wherein said first bushing and said second bushing each comprise an enlarged head portion, a cylindrical portion and a conical portion, and said bushings are positioned in said hole such that said conical portions project slightly into said central cavity.

4. The ripper of claim 3 wherein said pin comprises a cap screw and a hex nut.

5. In combination: a heavy tractor adapted for use in mining and quarrying operations; a ripper shank adapted for use in fracturing rock mounted on the rear of said tractor; and a hydraulic hammer adapted to deliver heavy impact blows to said shank, said hammer comprising: a housing having a generally cylindrical central cavity; a generally cylindrical tool partially disposed in said central cavity having a generally cylindrical upper portion having a first tool diameter, a generally cylindrical central portion having a second tool diameter and a lower portion, said tool upper portion and said tool central portion being coaxial and said second tool diameter being smaller than said first tool diameter; and, retaining means comprising a pin intersecting said central cavity along a chord of the cross-section of said cavity preventing passage of said tool upper portion from said central cavity and allowing free rotation of said tool within said cavity, said tool resting against said shank in all normal operating positions whereby said shank absorbs impacts from said tool and said retaining pin is protected from impact damage.

6. A hydraulic hammer comprising: a housing having a generally cylindrical central cavity; a generally cylindrical tool partially disposed in said central cavity having a generally cylindrical upper portion having a first tool diameter, a generally cylindrical central portion having a second tool diameter and a lower portion, said tool upper portion and said tool central portion being coaxial and said second tool diameter being smaller than said first tool diameter; and, retaining means comprising a hole in said housing having an axis generally perpendicular to the axis of said central cavity, said hole intersecting said central cavity on a chord thereof, said hole containing a first bushing and a second bushing, said first bushing being disposed in said hole on a first side of said central cavity and said second bushing disposed in said hole on a second side of said central cavity, said pin passing through said first bushing and said second bushing, said retaining means preventing passage of said tool upper portion from said central cavity and allowing free rotation of said tool within said cavity.

7. The hydraulic hammer of claim 6 wherein said first bushing and said second bushing each comprise an enlarged head portion, a cylindrical portion and a conical portion, and said bushings are positioned in said hole such that said conical portions project slightly into said central cavity.

8. The hydraulic hammer of claim 7 wherein said pin comprises a cap screw and a hex nut.

9. A ripper comprising:

a tractor having a hydraulic power source;

a shank connected to said tractor supporting a tip adapted to break rock;

a hydraulic hammer mounted on said tractor including a tool having a longitudinal axis and adapted to deliver impact, said hammer mounted on said tractor such that said tool delivers impact to said shank, said tool being rotatable about said longitudinal axis;

said tool is generally cylindrical and said hammer additionally comprises a housing having a generally cylindrical central cavity surrounding a portion of said tool;

said tool comprises a generally cylindrical upper portion having a first tool diameter, a generally cylindrical central portion having a second tool diameter and a lower portion; said central cavity has a cavity diameter larger than said first tool diameter and said central cavity is provided with a tool retaining means preventing passage of said tool upper portion and not interfering with axial or rotational movement of said tool central portion;

said housing has a hole passing through said housing at a right angle to said central cavity and intersecting said central cavity and said tool retaining means comprises at least one bushing fitting snugly in said hole and a pin passing through said bushing and fixing said bushing in place, a portion of said tool retaining means extending into said central cavity sufficiently to prevent passage of said tool upper portion;

said hole contains a first bushing and a second bushing, said first bushing being disposed in said hole on a first side of said central cavity and said second bushing disposed in said hole on a second side of said central cavity, said pin passing through said first bushing and said second bushing; and said first bushing and said second bushing each comprise an enlarged head portion, a cylindrical portion and a conical portion, and said bushings are positioned in said hole such that said conical portions project slightly into said central cavity.

10. The ripper of claim 9, wherein said pin comprises a cap screw and a hex nut.

11. A hydraulic hammer comprising: a housing having a generally cylindrical central cavity; a generally cylindrical tool partially disposed in said central cavity having a generally cylindrical upper portion having a first tool diameter, a generally cylindrical central portion having a second tool diameter and a lower portion, said tool upper portion and said tool central portion being coaxial and said second tool diameter being smaller than said first tool diameter; retaining means preventing passage of said tool upper portion from said central cavity and allowing free rotation of said tool within said cavity;

said retaining means comprises a hole in said housing having an axis generally perpendicular to the axis of said central cavity, said hole intersecting said central cavity on a chord thereof, at least one bushing in said aperture and a pin within said bushing;

said hole contains a first bushing and a second bushing, said first bushing being disposed in said hole on a first side of said central cavity and said second bushing disposed in said hole on a second side of said central cavity, said pin passing through said first bushing and said second bushing;

and said first bushing and said second bushing each comprise an enlarged head portion, a cylindrical portion and a conical portion, and said bushings are positioned in said hole such that said conical portions project slightly into said central cavity.

12. The hydraulic hammer of claim 11, wherein said pin comprises a cap screw and a hex nut.

* * * * *